US009694421B2

(12) United States Patent
Calero et al.

(10) Patent No.: US 9,694,421 B2
(45) Date of Patent: Jul. 4, 2017

(54) METHOD OF PREHEATING A SET OF SHELL MOLDS FOR LOST-WAX CASTING

(71) Applicant: SNECMA, Paris (FR)

(72) Inventors: Patrick Albert Calero, Corregidora (MX); Bernard Louis Lallement, Eaubonne (FR); Serge Tenne, Asnieres (FR); Yvan Rappart, Montreuil (FR)

(73) Assignee: SNECMA, Paris (FR)

( * ) Notice: Subject to any disclaimer, the term of this patent is extended or adjusted under 35 U.S.C. 154(b) by 59 days.

(21) Appl. No.: 14/596,814

(22) Filed: Jan. 14, 2015

(65) Prior Publication Data

US 2015/0209861 A1 Jul. 30, 2015

(30) Foreign Application Priority Data

Jan. 24, 2014 (FR) ..... 14 50607

(51) Int. Cl.

| | |
|---|---|
| ***B22D 45/00*** | (2006.01) |
| ***B22C 9/04*** | (2006.01) |
| ***B22C 9/12*** | (2006.01) |
| ***F27D 3/00*** | (2006.01) |
| ***F27D 11/00*** | (2006.01) |
| ***F27D 1/18*** | (2006.01) |

(52) U.S. Cl.

CPC ..... *B22D 45/00* (2013.01); *B22C 9/04* (2013.01); *B22C 9/12* (2013.01); *F27D 1/1858* (2013.01); *F27D 3/0021* (2013.01); *F27D 11/00* (2013.01)

(58) Field of Classification Search

CPC ..... B22D 45/00; B22C 9/04; B22C 9/12
USPC ..... 164/121, 338.1, 361
See application file for complete search history.

(56) References Cited

U.S. PATENT DOCUMENTS

| | | | | |
|---|---|---|---|---|
| 3,348,605 A | | 10/1967 | Heron | |
| 3,680,625 A | * | 8/1972 | Hein et al. | B22D 27/045 164/122.1 |
| 3,741,281 A | * | 6/1973 | Hauser-Lienhard | B22C 9/046 164/253 |

(Continued)

FOREIGN PATENT DOCUMENTS

| | | |
|---|---|---|
| DE | 91 17 266 U1 | 11/1998 |
| FR | 908314 | 4/1946 |

OTHER PUBLICATIONS

French Preliminary Search Report issued Sep. 10, 2014, in French Application No. 14 50607 filed Jan. 24, 2014 (with English Translation of Categories of Cited Documents).

*Primary Examiner* — Kevin P Kerns
(74) *Attorney, Agent, or Firm* — Oblon, McClelland, Maier & Neustadt, L.L.P.

(57) ABSTRACT

A method including preheating a set of N shell molds for lost-wax casting, where the method can comprise: individually charging shell molds into n unit electric furnaces, each of which has previously been preheated to an initial loading temperature; starting a predefined preheating cycle for each shell mold charged in the unit electric furnaces, with a preheating cycle comprising raising the temperature of the furnace in compliance with a predefined ramp up to a predetermined setpoint temperature, and holding the furnace at the setpoint temperature for a predetermined duration; and at the end of each preheating cycle, unloading the shell mold in question and repeating the two preceding operations for another non-preheated shell mold.

8 Claims, 3 Drawing Sheets

(56) References Cited

U.S. PATENT DOCUMENTS

| | | | | |
|---|---|---|---|---|
| 4,131,475 | A * | 12/1978 | Svec | B22C 9/04 106/38.3 |
| 6,910,522 | B2 * | 6/2005 | Crafton et al. | B22D 29/00 164/345 |
| 9,381,569 | B2 * | 7/2016 | Vogt et al. | B22D 25/00 |

* cited by examiner

METHOD OF PREHEATING A SET OF SHELL MOLDS FOR LOST-WAX CASTING

BACKGROUND OF THE INVENTION

The present invention relates to the general field of making metal parts by a lost-wax casting method. The invention relates more particularly to preheating the shell molds that are used in such a casting method.

The lost-wax casting method consists of using wax to make an exact replica of the part that is to be fabricated. This model is covered by alternating and repeated dipping operations for building up a plurality of layers of ceramic in order to form a shell mold. After the wax has been eliminated, the shell mold is shaped with a cavity in which the smallest details of the part to be fabricated are reproduced. The "unwaxed" shell mold is then fired in a kiln, thereby giving it the mechanical properties it needs prior to having molten metal poured therein.

Furthermore, in order to avoid a thermal shock between the molten metal that is poured in at very high temperature (higher than 1000° C.) and the shell mold that receives it, the mold is subjected to a preheating operation that is likewise at high temperature (typically in the range 950° C. to 1200° C.). Once the shell mold has been preheated, it is placed in a pouring furnace in which it receives the molten metal. After the shell mold has cooled, it is destroyed and an exact copy of the wax model is thus obtained that is made out of metal.

It is known to perform the operation of preheating shell molds in gas furnaces that are dimensioned to receive a large number of shell molds. Generally, such furnaces are in the form of tunnel kilns into which the shell molds are charged for a typical duration of the order of six hours. More precisely, the shell molds are placed on bed plates mounted on carriages that are moved during a preheating cycle through the gas furnace from one of its ends to its other end. At the end of a preheating cycle, a plurality of shell molds are thus delivered from gas furnaces and can then be placed in the pouring furnace in order to receive the molten metal therein.

Such an operation of preheating shell molds by means of gas-fired tunnel kilns nevertheless presents numerous drawbacks. In particular, having recourse to organization of that type leaves no flexibility in managing production; a large quantity of shell molds are charged and it is not possible to change a temperature profile for a given batch (e.g. changing from a preheating temperature of 1100° C. to 950° C. on going from one shell mold to another).

It has also been found that the temperatures of shell molds within a single batch are not uniform on leaving gas furnaces, with temperature variations of plus or minus 15° C. relative to the setpoint temperature. Such non-uniformity may have the consequence of leading to metallurgical defects (of the crack type) in the parts that are to be fabricated.

Furthermore, having recourse to carriages that are movable in gas-fired tunnel kilns presents several disadvantages, such as considerable labor for installing and removing shell molds and a non-negligible risk of one or more shell molds breaking in such kilns.

Finally, gas-fired tunnel kilns have maintenance costs that are high, due in particular to the length of time needed to act on them, during which time the production means are completely unavailable.

OBJECT AND SUMMARY OF THE INVENTION

A main object of the present invention is thus to provide a method of preheating shell molds that does not present the above-mentioned drawbacks.

In accordance with the invention, this object is achieved by a method of preheating a set of N shell molds for lost-wax casting, the method comprising the following successive steps:

individually charging shell molds into n unit electric furnaces, each of which has previously been preheated to an initial loading temperature;

starting a predefined preheating cycle for each shell mold charged in the unit electric furnaces, with a preheating cycle comprising raising the temperature of the furnace in compliance with a predefined ramp up to a predetermined setpoint temperature, and holding the furnace at the setpoint temperature for a predetermined duration; and at the end of each preheating cycle, unloading the shell mold in question and repeating the two preceding steps for another non-preheated shell mold.

The method of the invention presents numerous advantages. In particular, having recourse to a plurality of unit electric furnaces makes great flexibility possible in managing the preheating of the set of N shell molds. Specifically, since the waiting time for changes in setpoint temperature is shortened, it is possible to produce shell molds that have been preheated with different temperature profiles (with the temperature profile being adapted to each shell mold), without any loss of productivity, and to do so in simultaneous manner.

Furthermore, having recourse to unit electric furnaces for preheating shell molds makes it possible to reduce considerably the difference in temperature between a preheated shell mold and the setpoint temperature (with a maximum variation of plus or minus 5° C. relative to the setpoint temperature). Any risk of giving rise to metallurgical defects in the fabricated parts are thus reduced.

The unit electric furnaces have relatively little inertia (compared with prior art gas-fired tunnel kilns), thus making it possible to have better temperature control over the method by using regulation that is accurate and repeatable. Furthermore, the duration of a preheating cycle is shorter than the duration of a preheating cycle using a prior art gas-fired tunnel kiln.

Even in the event of one of the unit electric furnaces failing, the production of preheated shell molds is not interrupted (since the other unit electric furnaces remain operational), thereby considerably reducing the impact of a failure on the production line. In particular, a failure does not lead to a total stop in production.

Finally, compared with a gas-fired tunnel kiln, unit electric furnaces present maintenance costs that are low, they do not give off pollutants of the carbon dioxide type, and they present energy costs that are much lower (as much as 80% lower). They can easily be moved within the installation, when necessary. It should also be observed that the shell molds are positioned in these unit electric furnaces on stationary bed plates, thereby limiting any risk of breaking.

The number n of unit electric furnaces may be less than the number N of shell molds for preheating. Specifically, the method of the invention makes it possible to produce preheated shell molds at an industrial rate.

At the end of unloading a shell mold, the method may further comprise putting the unit electric furnace in question to the initial loading temperature. Alternatively, when the temperature of the unit electric furnace in question at the end of unloading a shell mold is close to the initial loading temperature for the next shell mold for charging, the next shell mold is charged into the unit electric furnace without any prior change of temperature.

Preferably, the initial loading temperature is limited by a high temperature threshold that is defined so as to avoid any damage to the shell mold by thermal shock while it is being charged into the unit electric furnace, and the setpoint temperature for a preheating cycle is adapted to the pouring conditions for the shell mold.

Likewise, the rise in temperature of a preheating cycle may be spread over a duration lying in the range 15 minutes (min) to 60 min and the furnace may be held at the setpoint temperature for a period in the range 1.5 hours (h) to 3 h. By way of example, such values correspond to preheating shell molds for making turbine blades out of nickel-based superalloy.

The invention also provides a preheater installation for performing the method as defined above, the installation comprising n unit electric furnaces and it may also include at least one pouring furnace.

Each unit electric furnace may comprise a base having a stationary bed plate installed thereon to receive a shell mold, and a bell that is movable vertically in order to open and close the furnace, said bell being provided on its inside wall with electric heater resistances. Each unit electric furnace may likewise be associated with an individual control console.

BRIEF DESCRIPTION OF THE DRAWINGS

Other characteristics and advantages of the present invention appear from the description made below with reference to the accompanying drawings, which show an embodiment having no limiting character. In the figures.

DETAILED DESCRIPTION OF THE INVENTION

The invention relates to making metal parts by lost-wax casting, e.g. metal blades for a low pressure turbine or ring sectors for an aviation turbine engine.

Figure 1:
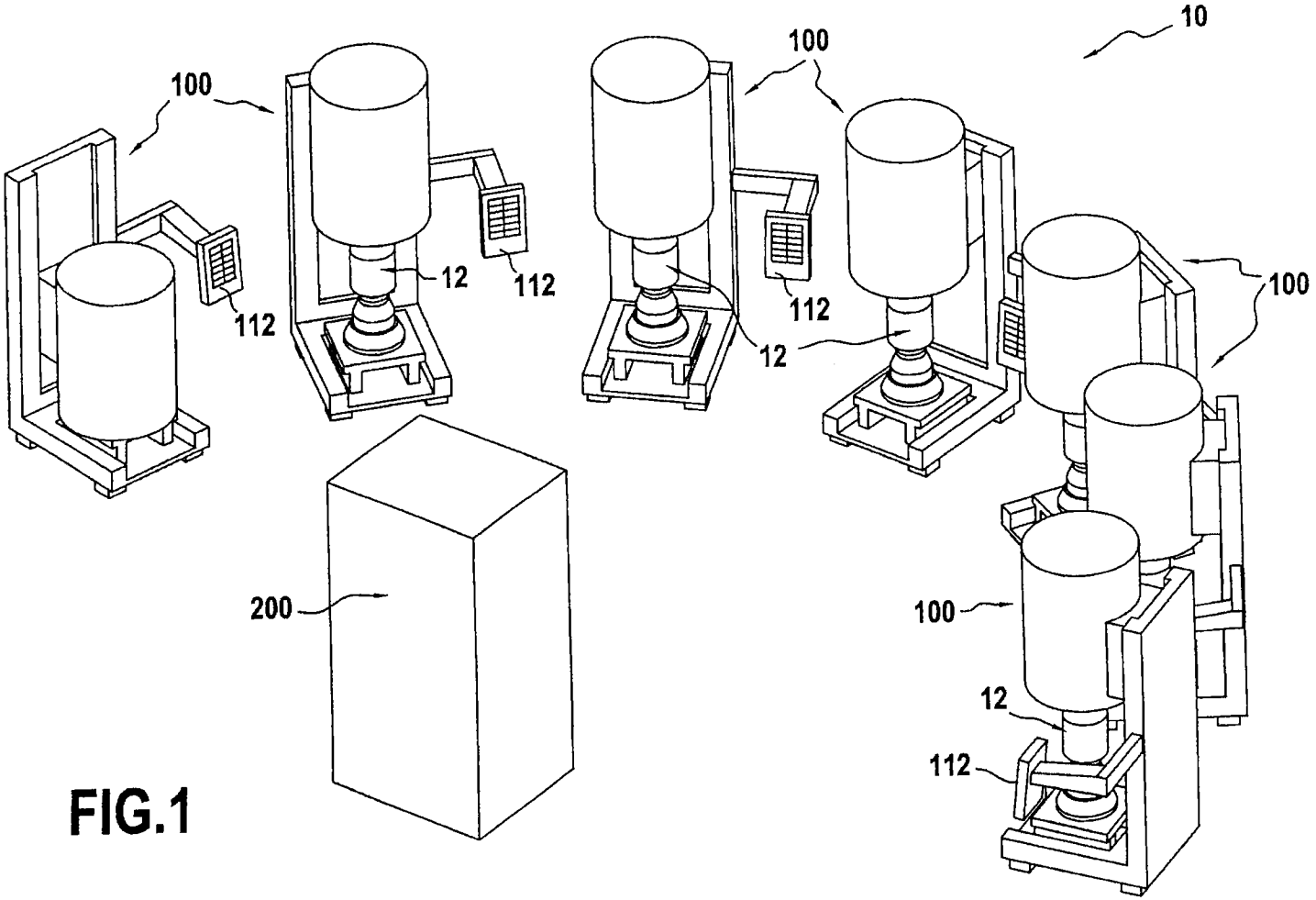
FIG. 1 is a diagrammatic view of an installation for performing the preheating method of the invention.

FIG. 1 is a diagram showing an embodiment of a preheater installation 10 for performing the method of the invention for preheating a set of N shell molds 12, the shell molds 12 being used for making such metal parts by lost-wax casting.

In known manner, the shell molds are fabricated around wax models of the metal parts that are to be made by performing alternating and repeated operations of dipping in a ceramic slip and of stuccoing ceramic materials. The shell molds are then fired in a kiln in order to enable them to acquire the mechanical strength needed for withstanding the casting of molten metal. In order to avoid any thermal shock between the molten metal that is poured at very high temperature (typically higher than 1000° C.) and the shell molds that receive the metal, the molds are subjected to a preheating operation that is likewise at high temperature and that is performed with the installation of FIG. 1.

In the invention, the preheater installation 10 comprises n unit electric furnaces 100 (there being seven in the example shown), each suitable for receiving a single shell mold 12, together with at least one pouring furnace 200 for receiving a preheated shell mold in order to pour molten metal into it.

Figure 2B:
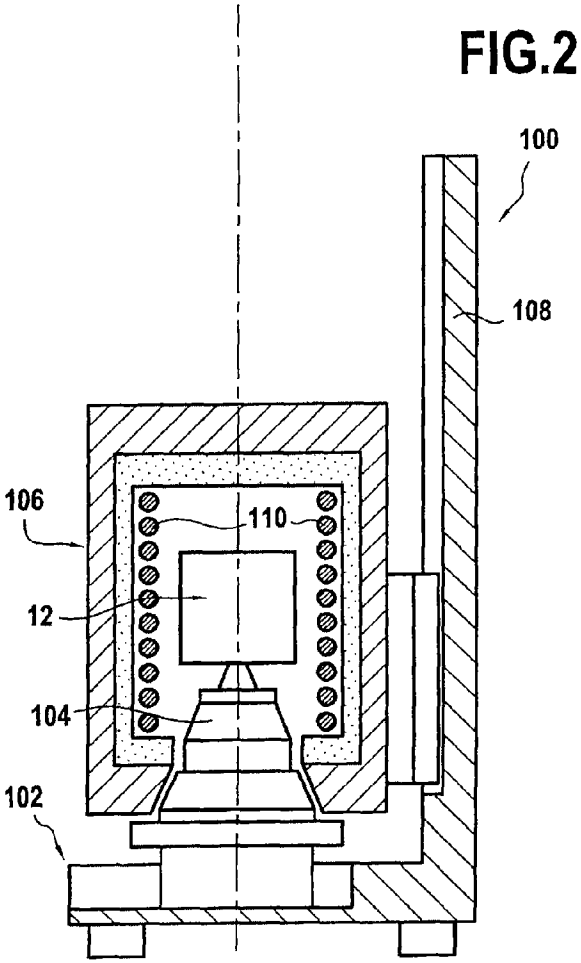
FIGS. 2A and 2B are section views of a unit electric furnace of the FIG. 1 installation.
Figure 2A:
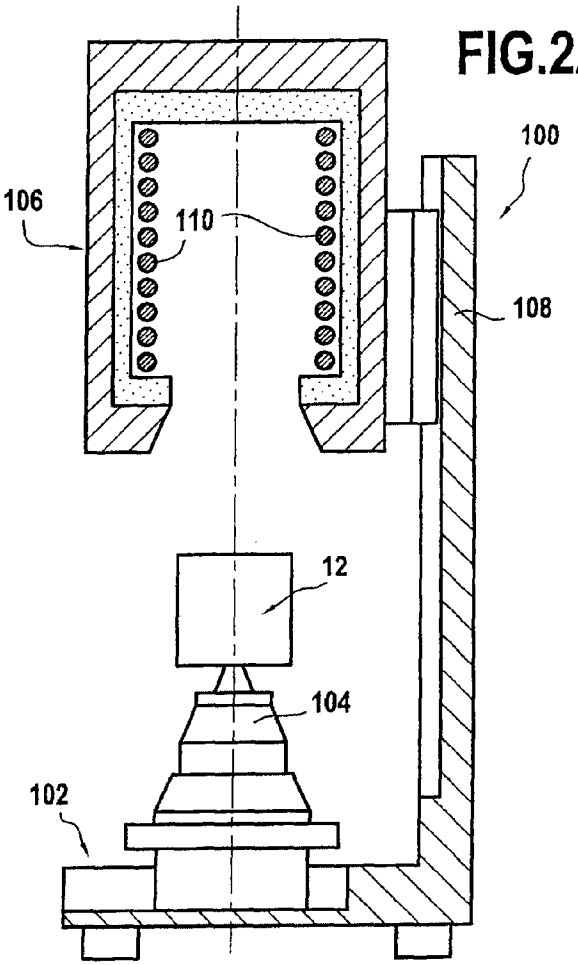

An embodiment of the unit electric furnaces 100 is shown in FIGS. 2A and 2B.

Each unit electric furnace 100 comprises a base 102 having a stationary bed plate 104 thereon for supporting a shell mold 12, together with a bell 106 that is movable vertically between a high position in which the furnace is open (FIG. 2A) and a low position in which the furnace is closed (FIG. 2B).

More precisely, the base 102 of each unit electric furnace has a vertical post 108 along which the bell 106 of the furnace can slide (e.g. by means of actuators that are not shown in the figures). The base 102 is adapted to make the furnace easy to transport, e.g. by means of a pallet truck.

Furthermore, the bell 106 is provided on its inside walls with electric heater resistances 110. These electric resistances 110 are dimensioned as a function of the size of the shell mold 12, in particular so as to enable the shell mold to be completely covered when the bell is in the closed position.

Finally, each unit electric furnace 100 is controlled by a control console 112 specific thereto (FIG. 1) so that the operation of each furnace is entirely independent of the operation of any other furnace.

Using such a heater installation, the method of the invention consists initially in preheating each of the n unit electric furnaces to an initial loading temperature $T_i$ (each unit electric furnace is associated with a particular initial loading temperature).

The initial loading temperature $T_i$ is limited by a high temperature threshold, which is defined so as to avoid any damage to the shell mold while it is being charged into the corresponding unit electric furnace. While a shell mold is being charged into the furnace, it suffers a thermal shock and a change of phase in its microstructure, giving rise to high levels of stress that might lead to cracks. Typically, the loading temperature lies in the range 800° C. to 1000° C.

By way of example, the loading temperature $T_i$ should be about 850° C. for low pressure turbine blades made of nickel-based superalloy, and 950° C. for ring sectors. Since the volume of a unit electric furnace is relatively small, such loading temperatures $T_i$ can be reached quickly.

At the end of this preheating of the n unit electric furnaces, an operator proceeds to charge each furnace with a shell mold 12 that is to be preheated. This charging takes place as a succession of manual actions, namely opening the bell 106 of the furnace, placing the shell mold 12 on the stationary bed plate 104 of the furnace, and closing the bell.

When a furnace is charged, the operator launches a preheating cycle that has previously been defined as a function of specific features desired for the charged shell mold. It should be observed that the great flexibility of the preheater installation of the invention makes it possible to adapt the temperature profile to each shell mold that is to be preheated.

A preheating cycle comprises a temperature rise of the corresponding furnace following a predefined ramp (i.e. at a predefined ratio of degrees per minute) up to a predetermined setpoint temperature $T_c$, and holding the furnace at the setpoint temperature $T_c$ for a predetermined duration (or temperature-holding period).

By way of example, the ramp should enable the temperature of the furnace to be raised from its loading temperature $T_i$ to its setpoint temperature $T_c$ in the space of about 15 min to 60 min.

The setpoint temperature $T_c$ is adapted to the pouring conditions for the shell mold. Typically, depending on the selected application, pouring may take place at a temperature in the range 950° C. to 1200° C. As for holding the furnace at its setpoint temperature $T_c$, this may be extended over a duration lying in the range 1.5 h to 3 h. By way of example, such values correspond to preheating shell molds for making turbine blades out of nickel-based superalloy.

At the end of the preheating cycle, the operator proceeds to unload the unit electric furnace in question. For this purpose, an indicator light is switched on the control console 112 of the furnace in question to inform the operator that the preheating cycle has ended. The operator then causes the bell of the furnace to open, and unloads the preheated shell mold in order to put it into position inside the pouring furnace 200, and then recloses the bell of the furnace. In parallel, the operator may start the step of pouring metal into the preheated shell mold that has been placed in the pouring furnace.

At the end of this step of unloading the unit electric furnace, the operator may proceed to place the temperature of the furnace at its initial loading temperature corresponding to the next shell mold that is to be preheated, prior to charging the furnace with that new shell mold.

Alternatively, when the temperature of the unit electric furnace at the end of unloading the preheated shell mold is close to the initial loading temperature for the next shell mold to be preheated (i.e. to within plus or minus 5° C., for example), there might be no need to preheat the furnace and it might be possible to charge it with the shell mold directly.

The operator can then start a new preheating cycle that is specific to the needs of the shell mold as charged in this way. This run of steps is thus continued until all of the N shell molds have been preheated and then placed in the pouring furnace in order to receive molten metal therein.

Figure 3:
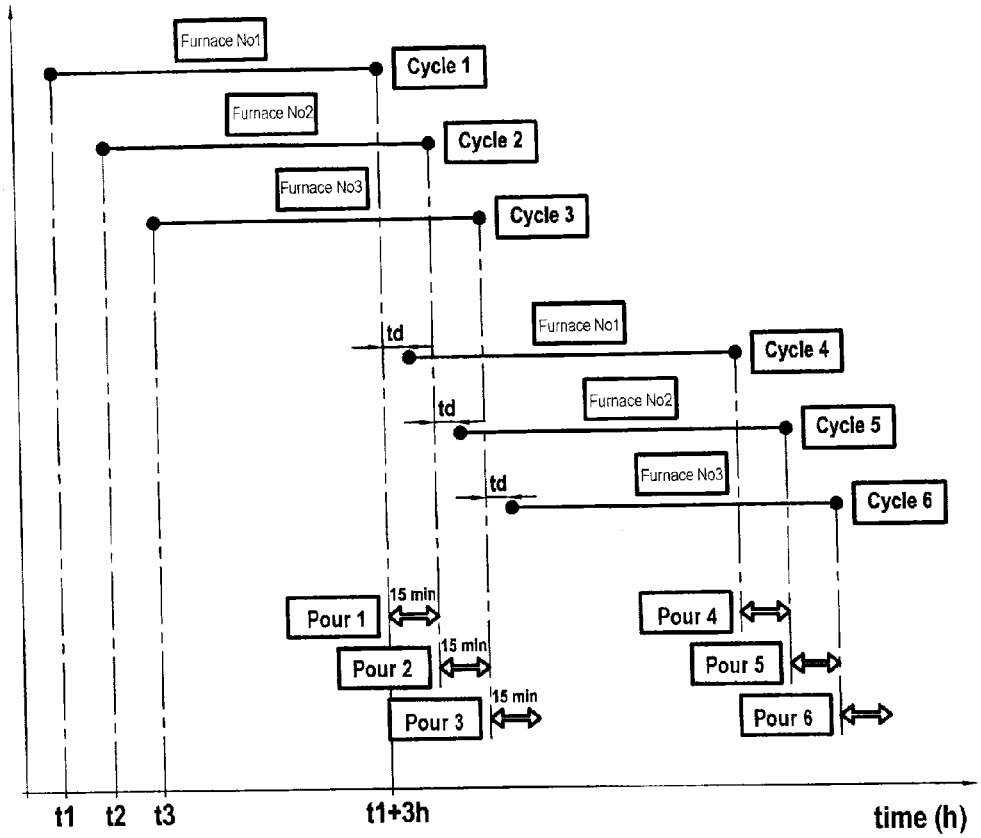
FIG. 3 shows an example of how to manage the production of preheated shell molds using the method of the invention.

FIG. 3 shows clearly how steps are run on and also the advantages in terms of flexibility in managing production when using a preheater installation that has three unit electric furnaces numbered "furnace No. 1", "furnace No. 2", and "furnace No. 3", together with a single pouring furnace.

Furnace No. 1 is charged first with a shell mold and the corresponding preheating cycle (referred to as "cycle 1") is launched at time "t1". Thereafter, furnace No. 2 and then furnace No. 3 are charged with shell molds and their corresponding preheating cycles (referred to as "cycle 2" and "cycle 3", respectively) are launched at times "t2" and "t3". For example, it is possible to make provision for a pause of about 15 min between starting each cycle.

At the end of "cycle 1" (e.g. at t1+3 h), furnace No. 1 is unloaded and the preheated shell mold is placed in the pouring furnace in order to have molten metal poured therein ("pour 1"). By way of example, this "pour 1" may last for 15 min. During this "pour 1", a new shell mold for preheating is charged into furnace No. 1 and a preheating cycle ("cycle 4") is started. The time td (e.g. of about 5 min) that is shown in FIG. 3 corresponds to the time for charging and preheating the furnace in question.

At the end of "cycle 2" (e.g. at t2+3 h), the pouring furnace is once more available ("pour 1" being completed) and it can thus receive the shell mold that has been preheated in furnace No. 2 for "pour 2". In parallel, furnace No. 2 is charged with a new shell mold for preheating prior to starting preheating "cycle 5".

Likewise, when "cycle 3" is completed, the pouring furnace is available ("pour 2" has terminated) for receiving the shell mold preheated in furnace No. 3 for "pour 3". Once it has been unloaded, furnace No. 3 is then charged once more with a new shell mold for preheating prior to starting preheating "cycle 6".

These operations follow on from one another until all of the N shell molds for preheating have been preheated in one of the furnaces No. 1, No. 2, or No. 3 and have had molten metal poured therein in the pouring furnace.

It should be observed that such a production rate is determined by the cycle of the pouring furnace (which has a duration of 15 min in this example). It should also be observed that depending on the various temperature profiles for the shell molds to be preheated, each of the n unit electric furnaces may be charged again after being unloaded.

Furthermore, the example shown in FIG. 3 proposes a preheater installation that has only three unit electric furnaces. Naturally, the dimensioning of the installation (i.e. the number n of unit electric furnaces) depends on the quantity N of shell molds to be preheated.

In particular, with a preheating cycle time of 3 h and a pouring duration of 15 min, a preheating installation having at least ten unit electric furnaces and a single pouring furnace can enable up to 96 shell molds to be preheated and to have metal poured into them per day when operation is continuous.

Even in the event of one of the unit electric furnaces failing, the production of shell molds is not interrupted, since the other unit electric furnaces continue to be operational.

Furthermore, such a preheater installation presents great flexibility since it is possible to run on between preheating temperature profiles that are different, and likewise it is possible to run on pouring operations for articles that are different.

The invention claimed is:

1. A method involving a plurality of metal parts, each metal part being molded from a shell mold for lost-wax casting, the method being carried out in an installation comprising a plurality of preheat electric furnaces and a single pouring furnace distinct from the plurality of preheat electric furnaces, the method comprising:

loading a first shell mold in a first preheat electric furnace which has previously been preheated to a first initial loading temperature;

starting a first predefined preheating cycle for the first shell mold charged in the first preheat electric furnace;

loading a second shell mold in a second preheat electric furnace which has previously been preheated to a second initial loading temperature;

starting a second predefined preheating cycle for the second shell mold charged in the second preheat electric furnace;

unloading the first shell mold from the first preheat electric furnace;

loading the unloaded first shell mold in the single pouring furnace;

introducing a molten metal in the first shell mold present in the single pouring furnace; and unloading the first shell mold from the single pouring furnace after pouring the molten metal in the first shell mold, wherein, during said introducing the molten metal in the first shell mold, the second shell mold is kept inside the second preheat electric furnace, the second shell mold being unloaded from the second preheat electric furnace and loaded in the single pouring furnace after the first shell mold is unloaded from the single pouring furnace.

2. The method according to claim 1, wherein a third shell mold is loaded in the first preheat electric furnace after the first shell mold is unloaded from the first preheat electric furnace.

3. The method according to claim 2, wherein the third shell mold is loaded in the first preheat electric furnace when the first preheat electric furnace is at the first initial loading temperature.

4. The method according to claim 2, wherein the third shell mold is loaded in the first preheat furnace when the temperature of the first preheat electric furnace after the first shell mold is unloaded is close to a third initial loading temperature for the third shell mold.

5. The method according to claim 1, wherein each said predefined preheating cycle comprises raising the temperature in a preheat electric furnace in compliance with a predefined ramp up to a predetermined setpoint temperature and holding said preheat electric furnace at the setpoint temperature for a predetermined duration.

6. The method according to claim 5, wherein the rise in the temperature of the preheating cycle is spread over a duration in the range of 15 minutes to 60 minutes, and the preheat electric furnace is held at the predetermined setpoint temperature for the predetermined duration in the range 1.5 hours to 3 hours.

7. The method according to claim 5, wherein each said predetermined setpoint temperature for the predefined preheating cycle is adapted to pouring conditions for a corresponding shell mold.

8. The method according to claim 1, wherein each said initial loading temperature is limited by a high temperature threshold that is defined so as to avoid any unwanted damage to a corresponding shell mold by thermal shock while said corresponding shell mold is being charged into a corresponding preheat electric furnace.

* * * * *